US006350346B1

(12) United States Patent
Nakashiba et al.

(10) Patent No.: US 6,350,346 B1
(45) **Date of Patent: *Feb. 26, 2002**

(54) APPARATUS FOR POLISHING WORKPIECE

(75) Inventors: Masamichi Nakashiba, Tokyo; Norio Kimura, Fujisawa; Isamu Watanabe, Tokyo; Yoko Hasegawa, Yokohama, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/288,768

(22) Filed: Apr. 9, 1999

Related U.S. Application Data

(63) Continuation of application No. 08/728,069, filed on Oct. 9, 1996, now Pat. No. 5,916,412.

(30) Foreign Application Priority Data

Feb. 16, 1996 (JP) ..... 8-54055
Jun. 11, 1996 (JP) ..... 8-171735

(51) Int. Cl.[7] ..... C23C 16/00
(52) U.S. Cl. ..... 156/345
(58) Field of Search ..... 156/345; 451/285–287, 451/41, 397, 398

(56) References Cited

U.S. PATENT DOCUMENTS 5,205,082 A 4/1993 Shendon et al. ..... 451/41
5,584,751 A 12/1996 Kobayashi et al. ..... 451/288
5,635,083 A 6/1997 Breivogel et al. ..... 216/88
5,645,474 A 7/1997 Kubo et al. ..... 451/287
5,681,215 A * 10/1997 Sherwood et al. ..... 451/388
5,707,492 A * 1/1998 Stager et al. ..... 438/693
5,795,215 A 8/1998 Guthrie et al. ..... 451/286
6,024,630 A * 2/2000 Shendon et al. ..... 451/41

FOREIGN PATENT DOCUMENTS

EP 0 383 910 8/1990
EP 0 747 167 12/1996
EP 0791431 * 8/1997
JP 50-133596 10/1975
JP 57-27659 2/1982
JP 2-503174 10/1990

* cited by examiner

*Primary Examiner*—Gregory Mills
*Assistant Examiner*—Luz Alejandro
(74) *Attorney, Agent, or Firm*—Wenderoth, Lind & Ponack, L.L.P.

(57) ABSTRACT

A polishing apparatus for polishing a workpiece such as a semiconductor wafer has a turntable with an abrasive cloth mounted on an upper surface thereof, and a top ring for holding a workpiece and pressing the workpiece against the abrasive cloth under a first pressing force to polish the workpiece. The top ring has a recess defined therein for accommodating the workpiece therein. A presser ring is vertically movably disposed around the top ring, and pressed against the abrasive cloth under a variable second pressing force. The first and second pressing forces are variable independently of each other, and the second pressing force is determined based on the first pressing force.

14 Claims, 16 Drawing Sheets

$F_1 > F_2$ $F_1 \fallingdotseq F_2$ $F_1 < F_2$

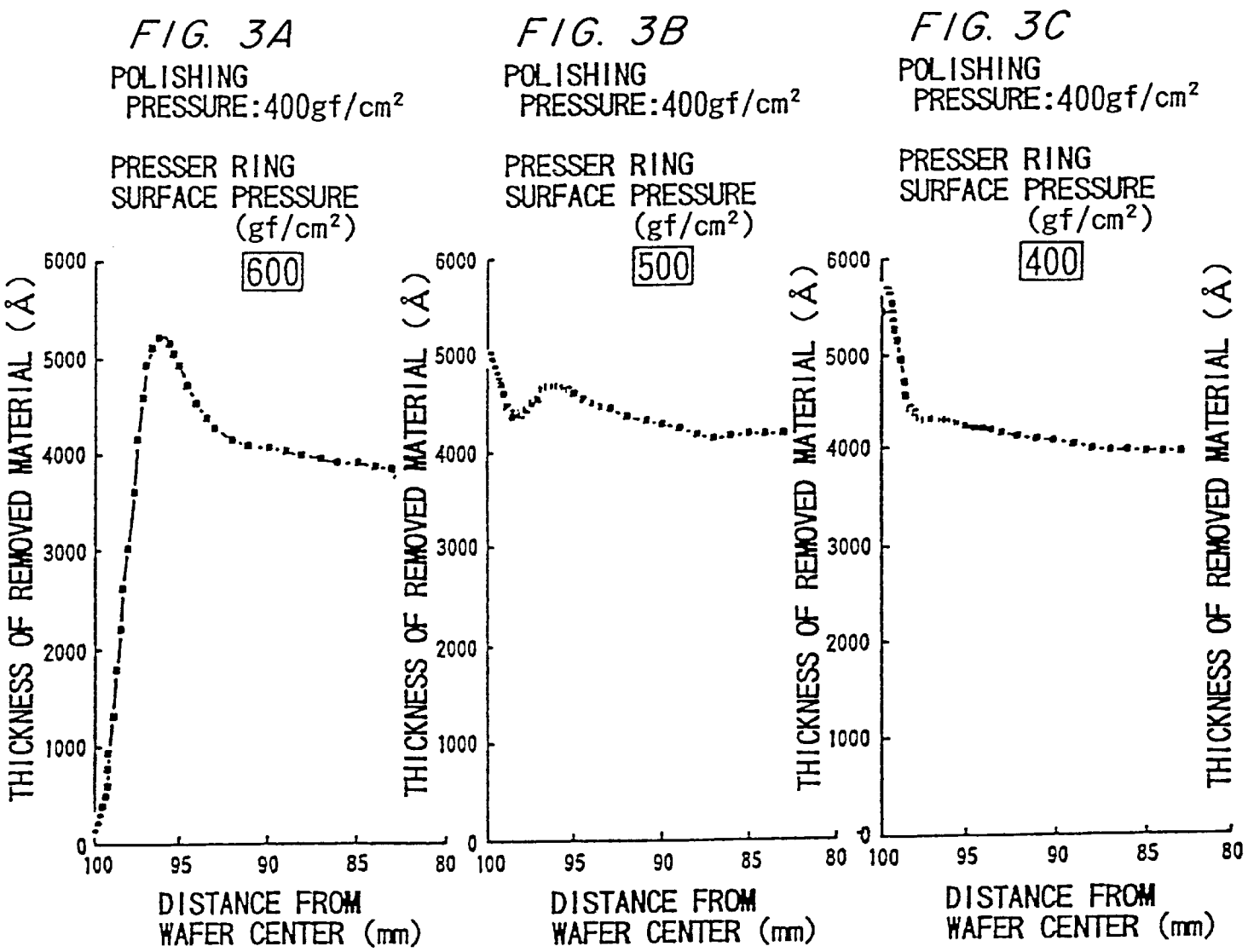
FIG. 3A
POLISHING PRESSURE: 400gf/cm²
PRESSER RING SURFACE PRESSURE (gf/cm²)
600
THICKNESS OF REMOVED MATERIAL (Å)
DISTANCE FROM WAFER CENTER (mm)
FIG. 3B
POLISHING PRESSURE: 400gf/cm²
PRESSER RING SURFACE PRESSURE (gf/cm²)
500
THICKNESS OF REMOVED MATERIAL (Å)
DISTANCE FROM WAFER CENTER (mm)
FIG. 3C
POLISHING PRESSURE: 400gf/cm²
PRESSER RING SURFACE PRESSURE (gf/cm²)
400
THICKNESS OF REMOVED MATERIAL (Å)
DISTANCE FROM WAFER CENTER (mm)

POLISHING PRESSURE: 400gf/cm²
PRESSER RING SURFACE PRESSURE (gf/cm²)
300

POLISHING PRESSURE: 400gf/cm²
PRESSER RING SURFACE PRESSURE (gf/cm²)
200
THICKNESS OF REMOVED MATERIAL (Å)
6000
5000
4000
3000
2000
1000
0
100
95
90
85
80
DISTANCE FROM WAFER CENTER (mm)

APPARATUS FOR POLISHING WORKPIECE

This is a continuation of application Ser. No. 08/728,069, filed Oct. 9, 1996 now U.S. Pat. No. 5,916,412.

BACKGROUND OF THE INVENTION

1. Field of the Invention

The present invention relates to an apparatus for and a method of polishing a workpiece such as a semiconductor wafer to a flat mirror finish, and more particularly to an apparatus for and a method of polishing a workpiece such as a semiconductor wafer which can control the amount of a material removed from a peripheral portion of the workpiece by a polishing action.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished to a flat mirror finish while the top ring and the turntable are rotating.

Attempts have heretofore been made to apply an elastic pad of polyurethane or the like to a workpiece holding surface of the top ring for uniformizing a pressing force applied from the top ring to the semiconductor wafer. If the pressing force applied from the top ring to the semiconductor wafer is uniformized, the semiconductor wafer is prevented from being excessively polished in a local area, and hence is planarized to a highly flat finish.

FIG. 15 of the accompanying drawings shows a conventional polishing apparatus. As shown in FIG. 15, the conventional polishing apparatus comprises a turntable 41 with an abrasive cloth 42 attached to an upper surface thereof, a top ring 45 for holding a semiconductor wafer 43 to press the semiconductor wafer 43 against the abrasive cloth 42, and an abrasive liquid supply nozzle 48 for supplying an abrasive liquid Q to the abrasive cloth 42. The top ring 45 is connected to a top ring shaft 49, and is provided with an elastic pad 47 of polyurethane or the like on its lower surface. The semiconductor wafer 43 is held by the top ring 45 in contact with the elastic pad 47. The top ring 45 also has a cylindrical retainer ring 46 on an outer circumferential edge thereof for retaining the semiconductor wafer 43 on the lower surface of the top ring 45. Specifically, the retainer ring 46 is fixed to the top ring 45, and has a lower end projecting downwardly from the lower surface of the top ring 45 for holding the semiconductor wafer 43 on the elastic pad 47 against removal from the top ring 45 under frictional engagement with the abrasive cloth 42 during a polishing process.

In operation, the semiconductor wafer 43 is held against the lower surface of the elastic pad 47 which is attached to the lower surface of the top ring 45. The semiconductor wafer 43 is then pressed against the abrasive cloth 42 on the turntable 41 by the top ring 45, and the turntable 41 and the top ring 45 are rotated independently of each other to move the abrasive cloth 42 and the semiconductor wafer 43 relatively to each other, thereby polishing the semiconductor wafer 43. The abrasive liquid Q comprises an alkaline solution containing an abrasive grain of fine particles suspended therein, for example. The semiconductor wafer 43 is polished by a composite action comprising a chemical polishing action of the alkaline solution and a mechanical polishing action of the abrasive grain.

FIG. 16 of the accompanying drawings shows in a fragmental cross-section the semiconductor wafer 43, the abrasive cloth 42, and the elastic pad 47. As shown in FIG. 16, the semiconductor wafer 43 has a peripheral portion which is a boundary between contact and noncontact with the abrasive cloth 42 and also is a boundary between contact and noncontact with the elastic pad 47. At the peripheral portion of the semiconductor wafer 43, the polishing pressure applied to the semiconductor wafer 43 by the abrasive cloth 42 and the elastic pad 47 is not uniform, thus the peripheral portion of the semiconductor wafer 43 is liable to be polished to an excessive degree. As a result, the peripheral edges of the semiconductor wafer 43 often are rounded during polishing.

FIG. 17 of the accompanying drawings illustrates the relationship between radial positions and polishing pressures calculated by the finite element method, and the relationship between radial positions and thicknesses of a surface layer, with respect to a 6-inch semiconductor wafer having a silicon oxide layer ($SiO_2$) deposited thereon. In FIG. 17, blank dots represent calculated values of the polishing pressure (gf/cm$^2$) as determined by the finite element method, and solid dots represent measured values of the thickness of the surface layer (Å) after the semiconductor wafer was polished. The calculated values of the polishing pressure are irregular at a peripheral portion ranging from 70 mm to 74 mm on the semiconductor wafer, and the measured values of the thickness of the surface layer are correspondingly irregular at a peripheral portion ranging from 70 mm to 73.5 mm on the semiconductor wafer. As can be seen from the measured values of the thickness of the surface layer, the peripheral portion of the semiconductor wafer is excessively polished.

In order to prevent the peripheral portion of the semiconductor wafer from being excessively polished, there has been proposed a polishing apparatus having a retainer ring comprising a weight which is vertically movable with respect to a top ring as disclosed in Japanese laid-open patent publication No. 55-157473. In this polishing apparatus, the retainer ring is provided around the top ring and pressed against an abrasive cloth due to gravity.

The top ring of the above proposed polishing apparatus is capable of varying the pressing force for pressing the semiconductor wafer against the abrasive cloth depending on the type of the semiconductor wafer and the polishing conditions. However, since the retainer ring cannot vary its pressing force applied against the abrasive cloth, the pressing force applied by the retainer ring may be too large or too small compared to the adjusted pressing force imposed by the top ring. As a consequence, the peripheral portion of the semiconductor wafer may be polished excessively or insufficiently.

According to another proposed polishing apparatus disclosed in Japanese patent publication No. 58-10193, a spring is interposed between a top ring and a retainer ring for resiliently pressing the retainer ring against an abrasive cloth.

The spring-loaded retainer ring exerts a pressing force which is not adjustable because the pressing force is dependent on the spring that is used. Therefore, whereas the top ring can vary its pressing force for pressing the semiconductor wafer against the abrasive cloth depending on the type of the semiconductor wafer and the polishing conditions, the pressing force applied to the abrasive cloth by the retainer ring cannot be adjusted. Consequently, the pressing force applied by the retainer ring may be too large or too small compared to the adjusted pressing force imposed by the top ring. The peripheral portion of the semiconductor wafer may thus be polished excessively or insufficiently.

SUMMARY OF THE INVENTION

It is therefore an object of the present invention to provide an apparatus for and a method of polishing a workpiece, with a presser ring disposed around a top ring for applying an optimum pressing force to an abrasive cloth depending on the type of a workpiece and the polishing conditions to thereby prevent a peripheral portion of the workpiece from being polished excessively or insufficiently for thereby polishing the workpiece to a highly planarized finish.

Another object of the present invention is to provide an apparatus for and a method of polishing a workpiece while controlling the amount of a material removed from a peripheral portion of the workpiece by a polishing action in order to meet demands for the removal of a greater or smaller thickness of material from the peripheral portion of the workpiece than from an inner region of the workpiece depending on the type of the workpiece.

According to an aspect of the present invention, there is provided an apparatus for polishing a workpiece, comprising a turntable with an abrasive cloth mounted on an upper surface thereof, a top ring for holding a workpiece and pressing the workpiece against the abrasive cloth under a first pressing force to polish the workpiece, the top ring having a recess defined therein for accommodating the workpiece therein, a presser ring vertically movably disposed around the top ring, and a pressing device for pressing the presser ring against the abrasive cloth under a second pressing force which is variable.

According to another aspect of the present invention, there is provided a method of polishing a workpiece, comprising the steps of holding a workpiece between an abrasive cloth mounted on an upper surface of a turntable and a lower surface of a top ring disposed above the turntable, the top ring having a recess defined therein for accommodating the workpiece therein, pressing the workpiece against the abrasive cloth under a first pressing force to polish the workpiece, and pressing a presser ring vertically movably disposed around the top ring against the abrasive cloth around the workpiece under a second pressing force which is determined based on the first pressing force.

According to still another aspect of the present invention, there is provided a method of fabricating a semiconductor device, comprising the steps of holding a semiconductor wafer between an abrasive cloth mounted on an upper surface of a turntable and a lower surface of a top ring disposed above the turntable, the top ring having a recess defined therein for accommodating the workpiece therein, pressing the semiconductor wafer against the abrasive cloth under a first pressing force to polish the semiconductor wafer, and pressing a presser ring vertically movably disposed around the top ring against the abrasive cloth around the workpiece under a second pressing force which is determined based on the first pressing force.

According to the present invention, the distribution of the pressing force of the workpiece is prevented from being nonuniform at the peripheral portion of the workpiece during the polishing process, and the polishing pressures can be uniformized over the entire surface of the workpiece. Therefore, the peripheral portion of the semiconductor wafer is prevented from being polished excessively or insufficiently. The entire surface of workpiece can thus be polished to a flat mirror finish. In the case where the present invention is applied to semiconductor manufacturing processes, the semiconductor devices can be polished to a high quality. Since the peripheral portion of the semiconductor wafer can be used as products, yields of the semiconductor devices can be increased.

In the case where there are demands for the removal of a greater or smaller thickness of material from the peripheral portion of the semiconductor wafer than from the inner region of the semiconductor wafer depending on the -type of the semiconductor wafer, the amount of the material removed from the peripheral portion of the semiconductor wafer can be intentionally increased or decreased.

According to the present invention, since the workpiece is accommodated in the recess of the top ring and protected by the annular flange, the outer circumferential surface of the workpiece at its peripheral edge is not rubbed by the presser ring when the presser ring is vertically moved with respect to the top ring. Therefore, the presser ring as it is vertically moved with respect to the top ring does not adversely affect the polishing performance of the polishing apparatus during the polishing process. Further, since the presser ring does not contact the workpiece to be polished, the presser ring can be made of material high abrasion resistance and high hardness.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIGS. 3A through 3E are graphs showing theoretical results of polishing a semiconductor wafer based on the basic principles of the present invention;

DETAILED DESCRIPTION OF THE PREFERRED EMBODIMENTS

Figure 1:
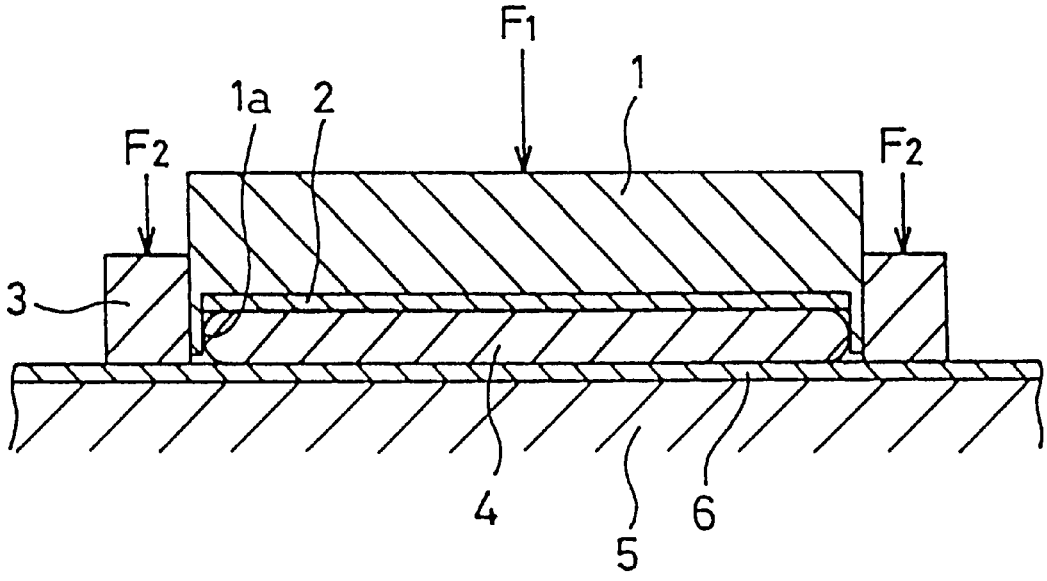
FIG. 1 is a fragmentary vertical cross-sectional view showing the basic principles of the present invention.

Like or corresponding parts are denoted by like or corresponding reference numerals throughout views.

FIG. 1 shows the basic principles of the present invention. As shown in FIG. 1, a top ring 1 has a recess 1*a* defined in a lower surface thereof for accommodating therein a semiconductor wafer 4 which is a workpiece to be polished and defining a retaining portion operable to retain an outer circumferential edge of water 4. An elastic pad 2 of polyurethane or the like is attached to the lower surface of the top ring 1. A presser ring 3 is disposed around the top ring 1 and is vertically movable with respect to the top ring 1.

The top ring 1 applies a pressing force $F_1$ (pressure per unit area, gf/cm$^2$) to press the semiconductor wafer 4 against an abrasive cloth 6 on a turntable 5, and the presser ring 3 applies a pressing force $F_2$ (pressure per unit area, gf/cm$^2$) to press the abrasive cloth 6. These pressing forces $F_1$, $F_2$ are variable independently of each other. Therefore, the pressing force $F_2$ which is applied to the abrasive cloth 6 by the presser ring 3 can be changed depending on the pressing force $F_1$ which is applied by the top ring 1 to press the semiconductor wafer 4 against the abrasive cloth 6.

Theoretically, if the pressing force $F_1$ which is applied by the top ring 1 to press the semiconductor wafer 4 against the abrasive cloth 6 is equal to the pressing force $F_2$ which is applied to the abrasive cloth 6 by the presser ring 3, then the distribution of applied polishing pressures, which result from a combination of the pressing forces $F_1$, $F_2$, is continuous and uniform from the center of the semiconductor wafer 4 to its peripheral edge and further to an outer circumferential edge of the presser ring 3 disposed around the semiconductor wafer 4. Accordingly, the peripheral portion of the semiconductor wafer 4 is prevented from being polished excessively or insufficiently.

Figure 2A:
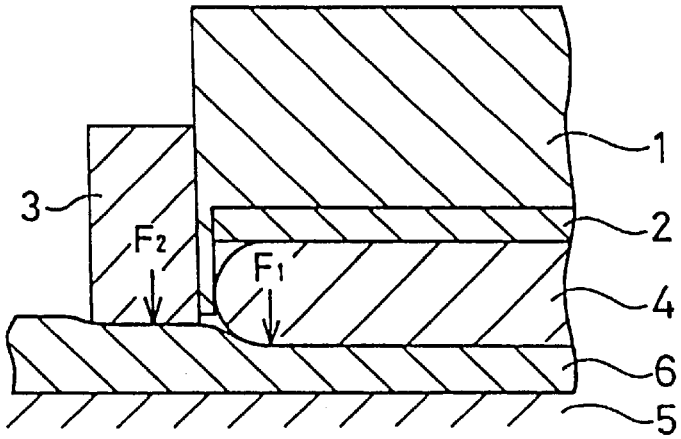
FIGS. 2A, 2B, and 2C are enlarged fragmentary vertical cross-sectional views showing the behavior of an abrasive cloth when the relationship between a pressing force applied by a top ring and a pressing force applied by a presser ring is varied.
Figure 2B:
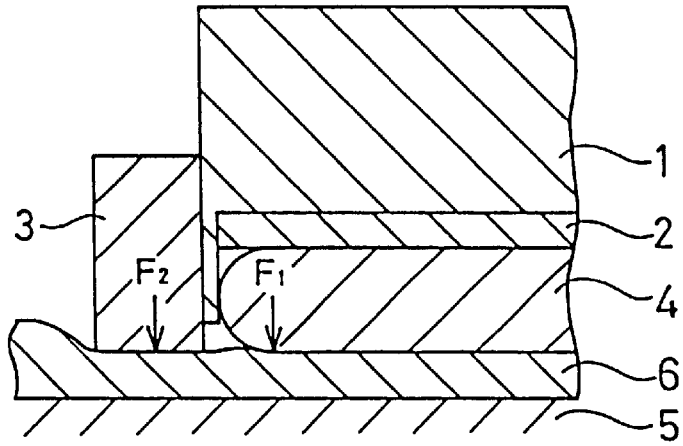
Figure 2C:
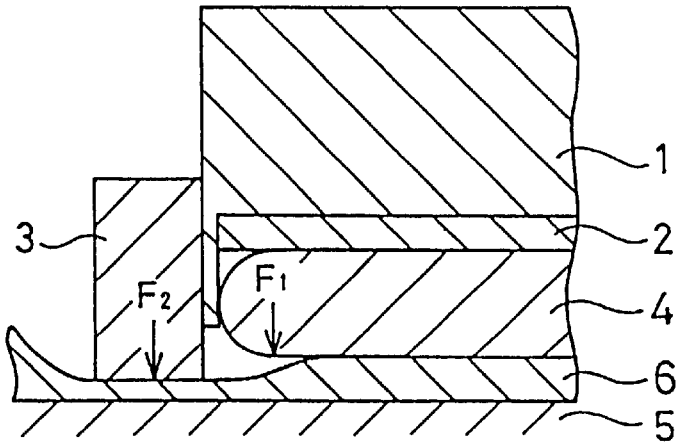

FIGS. 2A through 2C schematically show how the abrasive cloth 6 behaves when the relationship between the pressing force $F_1$ and the pressing force $F_2$ is varied. In FIG. 2A, the pressing force $F_1$ is greater than the pressing force $F_2$ ($F_1>F_2$). In FIG. 2B, the pressing force $F_1$ is nearly equal to the pressing force $F_2$ ($F_1 \approx F_2$). In FIG. 2C, the pressing force $F_1$ is smaller than the pressing force $F_2$ ($F_1<F_2$).

As shown in FIGS. 2A through 2C, when the pressing force $F_2$ applied to the abrasive cloth 6 by the presser ring 3 is progressively increased, the abrasive cloth 6 pressed by the presser ring 3 is progressively compressed, thus progressively changing its state of contact with the peripheral portion of the semiconductor wafer 4, i.e., progressively reducing its area of contact with the peripheral portion of the semiconductor wafer 4. Therefore, when the relationship between the pressing force $F_1$ and the pressing force $F_2$ is changed in various patterns, the distribution of polishing pressures on the semiconductor wafer 4 over its peripheral portion and inner region is also changed in various patterns.

As shown in FIG. 2A, when the pressing force $F_1$ is greater than the pressing force $F_2$ ($F_1>F_2$), the polishing pressure applied to the peripheral portion of the semiconductor wafer 4 is greater than the polishing pressure applied to the inner region of the semiconductor wafer 4, so that the amount of a material removed from the peripheral portion of the semiconductor wafer 4 is greater than the amount of a material removed from the inner region of the semiconductor wafer 4 while the semiconductor wafer 4 is being polished.

As shown in FIG. 2B, when the pressing force $F_1$ is substantially equal to the pressing force $F_2$ ($F_1 \approx F_2$), the distribution of polishing pressures is continuous and uniform from the center of the semiconductor wafer 4 to its peripheral edge and further to the outer circumferential edge of the presser ring 3, so that the amount of a material removed from the semiconductor wafer 4 is uniform from the peripheral edge to the inner region of the semiconductor wafer 4 while the semiconductor wafer 4 is being polished.

As shown in FIG. 2C, when the pressing force $F_1$ is smaller than the pressing force $F_2$ ($F_1<F_2$), the polishing pressure applied to the peripheral portion of the semiconductor wafer 4 is smaller than the polishing pressure applied to the inner region of the semiconductor wafer 4, so that the amount of a material removed from the peripheral edge of the semiconductor wafer 4 is smaller than the amount of a material removed from the inner region of the semiconductor wafer 4 while the semiconductor wafer 4 is being polished.

The pressing force $F_1$ and the pressing force $F_2$ can be changed independently of each other before polishing or during polishing.

FIGS. 3A through 3E show theoretical results of poilishing a semiconductor wafer based on the basic principles of the present invention. The semiconductor wafer is an 8-inch semiconductor wafer. The pressing force (polishing pressure) applied to the semiconductor wafer by the top ring is a constant level of 400 gf/cm$^2$, and the pressing force applied by the presser ring is changed from 600 to 200 gf/cm$^2$ successively by decrements of 100 gf/cm$^2$. Specifically, the pressing force applied by the presser ring is 600 gf/cm$^2$ in FIG. 3A, 500 gf/cm$^2$ in FIG. 3B, 400 gf/cm$^2$ in FIG. 3C, 300 gf/cm$^2$ in FIG. 3D, and 200 gf/cm$^2$ in FIG. 3E. In each of FIGS. 3A through 3E, the horizontal axis represents a distance (mm) from the center of the semiconductor wafer, and the vertical axis represents a thickness (Å) of a material removed from the semiconductor wafer.

Figures 3D, 3E:
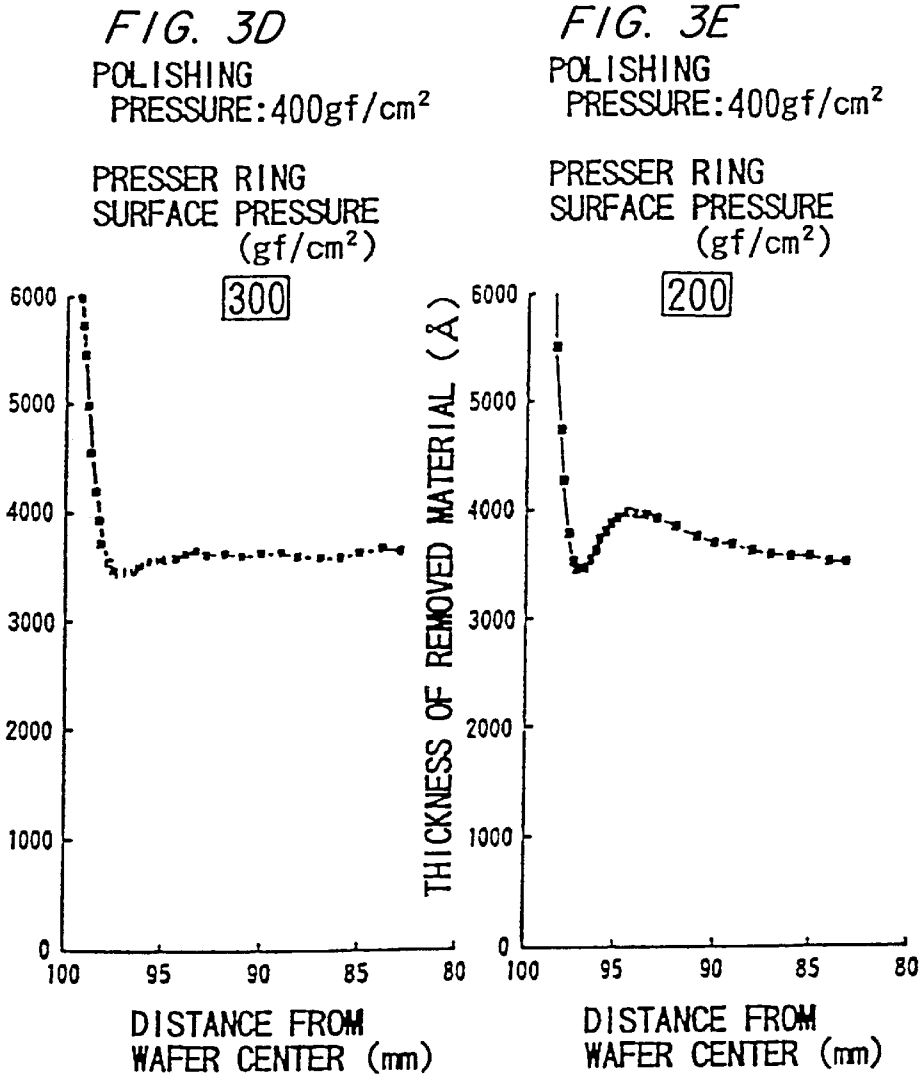

As shown in FIGS. 3A through 3E, the thickness of the removed material at the radial positions on the semiconductor wafer is affected when the pressing force applied by the presser ring is changed. Specifically, when the pressing force applied by the presser ring is in the range from 200 to 300 gf/cm$^2$, as shown in FIGS. 3D and 3E, the peripheral portion of the semiconductor wafer is excessively polished. When the pressing force applied by the presser ring is in the range from 400 to 500 gf/cm$^2$, as shown in FIGS. 3B and 3C, the peripheral portion of the semiconductor wafer is substantially equally polished from the peripheral edge to the inner region of the semiconductor wafer. When the pressing force applied by the presser ring is 600 gf/cm$^2$, as shown in FIG. 3A, the peripheral portion of the semiconductor wafer is polished insufficiently.

The theoretical results shown in FIGS. 3A through 3E indicate that the amount of the material removed from the peripheral portion of the semiconductor wafer can be adjusted by varying the pressing force applied by the presser ring independently of the pressing force applied by the top ring. From a theoretical standpoint, the peripheral portion of the semiconductor wafer should be polished optimally when the pressing force applied by the presser ring is equal to the pressing force applied by the top ring. However, since the polishing action depends on the type of the semiconductor wafer and the polishing conditions, the pressing force applied by the presser ring is selected to be of an optimum value based on the pressing force applied by the top ring depending on the type of the semiconductor wafer and the polishing conditions.

There are demands for the removal of a greater or smaller thickness of material from the peripheral portion of the semiconductor wafer than from the inner region of the semiconductor wafer depending on the type of the semiconductor wafer. To meet such demands, the pressing force applied by the presser ring is selected to be of an optimum value based on the pressing force applied by the top ring to intentionally increase or reduce the amount of the material removed from peripheral portion of the semiconductor wafer.

According to the present invention, since the workpiece is accommodated in the recess of the top ring and protected by the annular flange, the outer circumferential surface of the semiconductor wafer at its peripheral edge is not rubbed by the presser ring when the presser ring is vertically moved with respect to the top ring. Therefore, the presser ring as it is vertically moved with respect to the top ring does not adversely affect the polishing performance of the polishing apparatus during the polishing process. Further, since the presser ring does not contact the semiconductor wafer to be polished, the presser ring can be made of material high abrasion resistance and high hardness.

Figure 4:
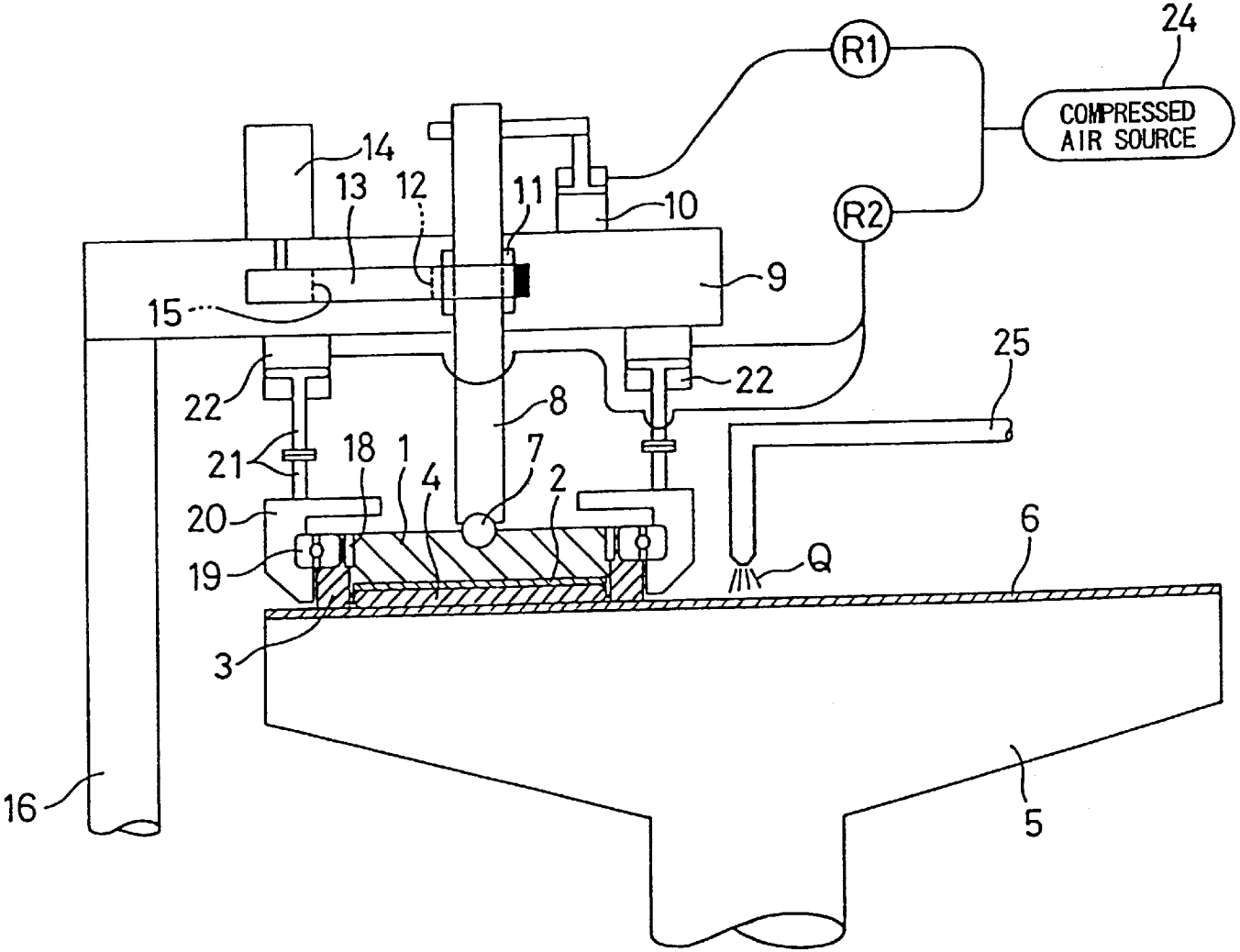
FIG. 4 is a vertical cross-sectional view of a polishing apparatus according to a first embodiment of the present invention.
Figure 5:
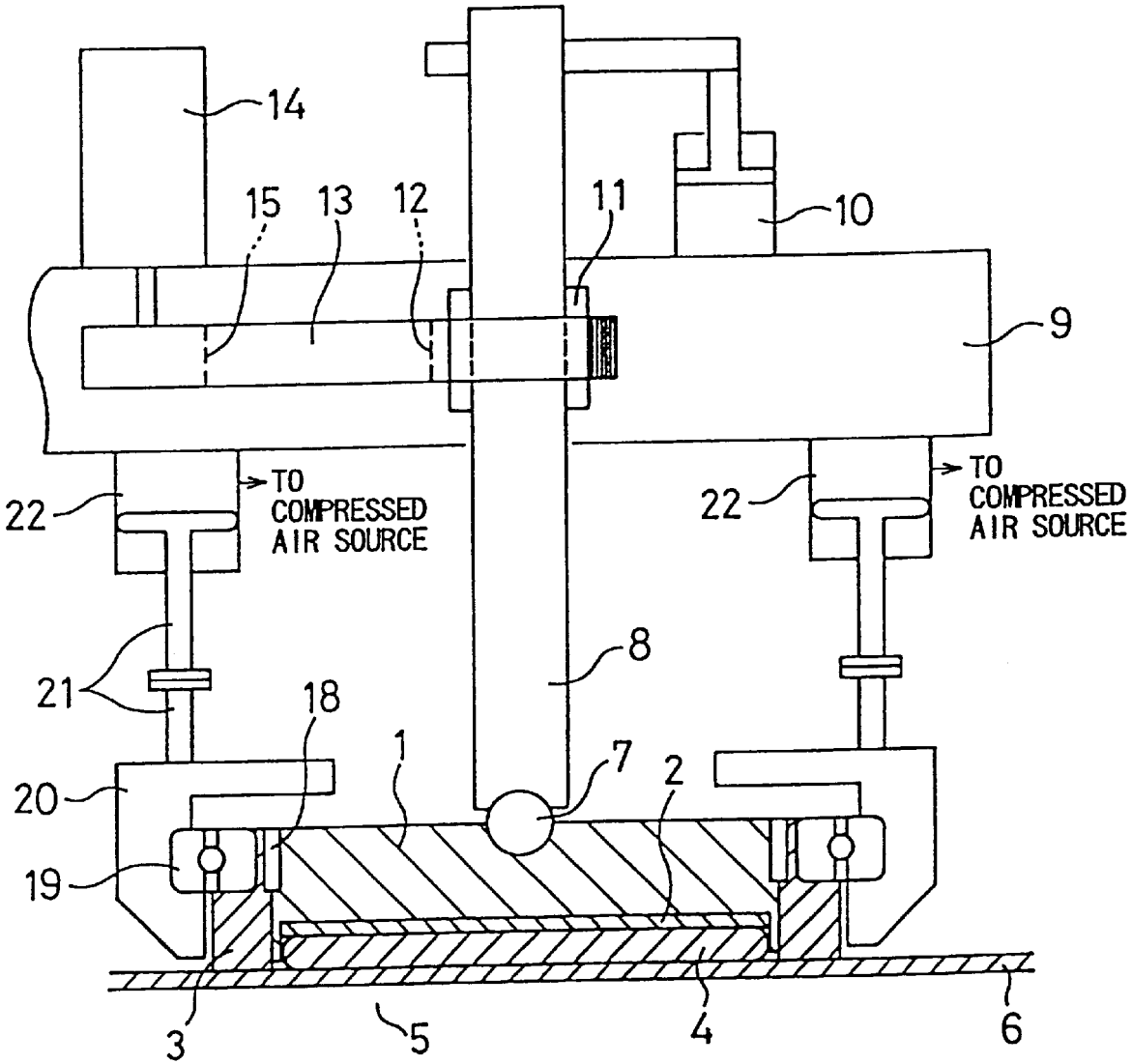
FIG. 5 is an enlarged fragmentary vertical cross-sectional view of the polishing apparatus according to the first embodiment.
Figure 6:
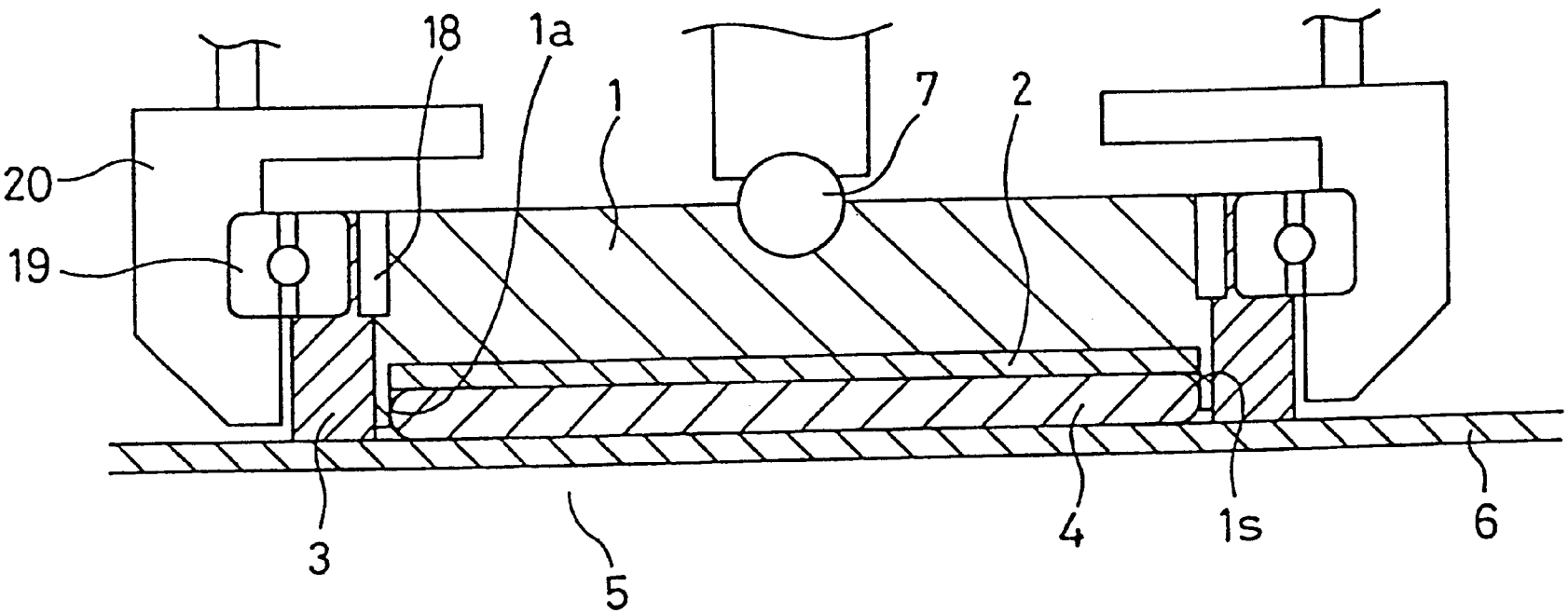
FIG. 6 is an enlarged vertical cross-sectional view showing details of a top ring and a presser ring of the polishing apparatus according to the first embodiment.

FIGS. 4, 5, and 6 show a polishing apparatus according to a first embodiment of the present invention.

As shown in FIGS. 4 and 5, a top ring 1 has a lower surface for supporting a semiconductor wafer 4 thereon which is a workpiece to be polished. An elastic pad 2 of polyurethane or the like is attached to the lower surface of the top ring 1. A presser ring 3 is disposed around the top ring 1 and vertically movable with respect to the top ring 1. A turntable 5 with an abrasive cloth 6 attached to an upper surface thereof is disposed below the top ring 1.

The top ring 1 is connected to a vertical top ring shaft 8 whose lower end is held against a ball 7 mounted on an upper surface of the top ring 1. The top ring shaft 8 is operatively coupled to a top ring air cylinder 10 fixedly mounted on an upper surface of a top ring head 9. The top ring shaft 8 is vertically movable by the top ring air cylinder 10 to press the semiconductor wafer 4 supported on the elastic pad 2 against the abrasive cloth 6 on the turntable 5.

The top ring shaft 8 has an intermediate portion extending through and corotatably coupled to a rotatable cylinder 11 by a key (not shown), and the rotatable cylinder 11 has a pulley 12 mounted on outer circumferential surface thereof. The pulley 12 is operatively connected by a timing belt 13 to a timing pulley 15 mounted on the rotatable shaft of a top ring motor 14 which is fixedly mounted on the top ring head 9. Therefore, when the top ring motor 14 is energized, the rotatable cylinder 11 and the top ring shaft 8 are integrally rotated through the timing pulley 15, the timing belt 13 and the timing pulley 12. Thus the top ring 1 is rotated. The top ring head 9 is supported by a top ring head shaft 16 which is vertically fixed on a frame (not shown).

The presser ring 3 is corotatably, but vertically movably, coupled to the top ring 1 by a key 18. The presser ring 3 is rotatably supported by a bearing 19 which is mounted on a bearing holder 20. The bearing holder 20 is connected by vertical shafts 21 to a plurality of (three in this embodiment) circumferentially spaced presser ring air cylinders 22. The presser ring air cylinders 22 are secured to a lower surface of the top ring head 9.

The top ring air cylinder 10 and the presser ring air cylinders 22 are pneumatically connected to a compressed air source 24 through regulators R1, R2, respectively. The regulator R1 regulates an air pressure supplied from the compressed air source 24 to the top ring air cylinder 10 to adjust the pressing force which is applied by the top ring 1 to press the semiconductor wafer 4 against the abrasive cloth 6. The regulator R2 also regulates the air pressure supplied from the compressed air source 24 to the presser ring air cylinder 22 to adjust the pressing force which is applied by the presser ring 3 to press the abrasive cloth 6. The regulators R1 and R2 are controlled by a controller (not shown in FIG. 4).

An abrasive liquid supply nozzle 25 is positioned above the turntable 5 for supplying an abrasive liquid Q onto the abrasive cloth 6 on the turntable 5.

As shown in FIG. 6, the top ring 1 has an outer circumferential annular flange 1*s* extending downwardly toward the turntable 5. The lower surface of the top ring 1 and the annular flange is jointly define a recess 1*a* for accommodating the semiconductor wafer 4 therein.

The polishing apparatus shown in FIGS. 4, 5, and 6 operates as follows: The semiconductor wafer 4 to be polished is placed in the recess 1*a* and held against the elastic pad 2, and the top ring air cylinder 10 is actuated to lower the top ring 1 toward the turntable 5 until the semiconductor wafer 4 is pressed against the abrasive cloth 6 on the upper surface of the rotating turntable 5. The top ring 1 and the presser ring 3 are rotated by the top ring motor 14 through the top ring shaft 8. Since the abrasive liquid Q is supplied onto the abrasive cloth 6 by the abrasive liquid supply nozzle 25, the abrasive liquid Q is retained on the abrasive cloth 6. Therefore, the lower surface of the semiconductor wafer 4 is polished with the abrasive liquid Q which is present between the lower surface of the semiconductor wafer 4 and the abrasive cloth 6.

Depending on the pressing force applied by the top ring 1 actuated by the top ring air cylinder 10, the pressing force applied to the abrasive cloth 6 by the presser ring 3 actuated by the presser ring air cylinders 22 is adjusted while the semiconductor wafer 4 is being polished. During the polishing process, the pressing force $F_1$ (see FIG. 1) which is applied by the top ring 1 to press the semiconductor wafer 4 against the abrasive cloth 6 can be adjusted by the regulator R1, and the pressing force $F_2$ which is applied by the presser ring 3 to press the abrasive cloth 6 can be adjusted by the regulator R2. Therefore, during the polishing process, the pressing force $F_2$ applied by the presser ring 3 to press the abrasive cloth 6 can be changed depending on the pressing force $F_1$ applied by the top ring 1 to press the semiconductor wafer 4 against the abrasive cloth 6. By adjusting the pressing force $F_2$ with respect to the pressing force $F_1$, the distribution of polishing pressures is made continuous and uniform from the center of the semiconductor wafer 4 to its. peripheral edge and further to the outer circumferential edge of the presser ring 3 disposed around the semiconductor wafer 4. Consequently, the peripheral portion of the semiconductor wafer 4 is prevented from being polished excessively or insufficiently. The semiconductor wafer 4 can thus be polished to a high quality and with a high yield.

If a greater or smaller thickness of material is to be removed from the peripheral portion of the semiconductor wafer 4 than from the inner region of the semiconductor wafer 4, then the pressing force $F_2$ applied by the presser ring 3 is selected to be of a suitable value based on the pressing force $F_1$ applied by the top ring 1 to intentionally increase or reduce the amount of a material removed from the peripheral portion of the semiconductor wafer 4.

In the first embodiment, since the semiconductor wafer 4 is accommodated in the recess 1*a* of the top ring 1 and protected by the annular flange 1*s*, the outer circumferential surface of the semiconductor wafer 4 at its peripheral edge is not rubbed by the presser ring 3 when the presser ring 3 is vertically moved with respect to the top ring 1. Therefore, the presser ring 3 as it is vertically moved with respect to the top ring 1 does not adversely affect the polishing performance of the polishing apparatus during the polishing process.

Figure 7:
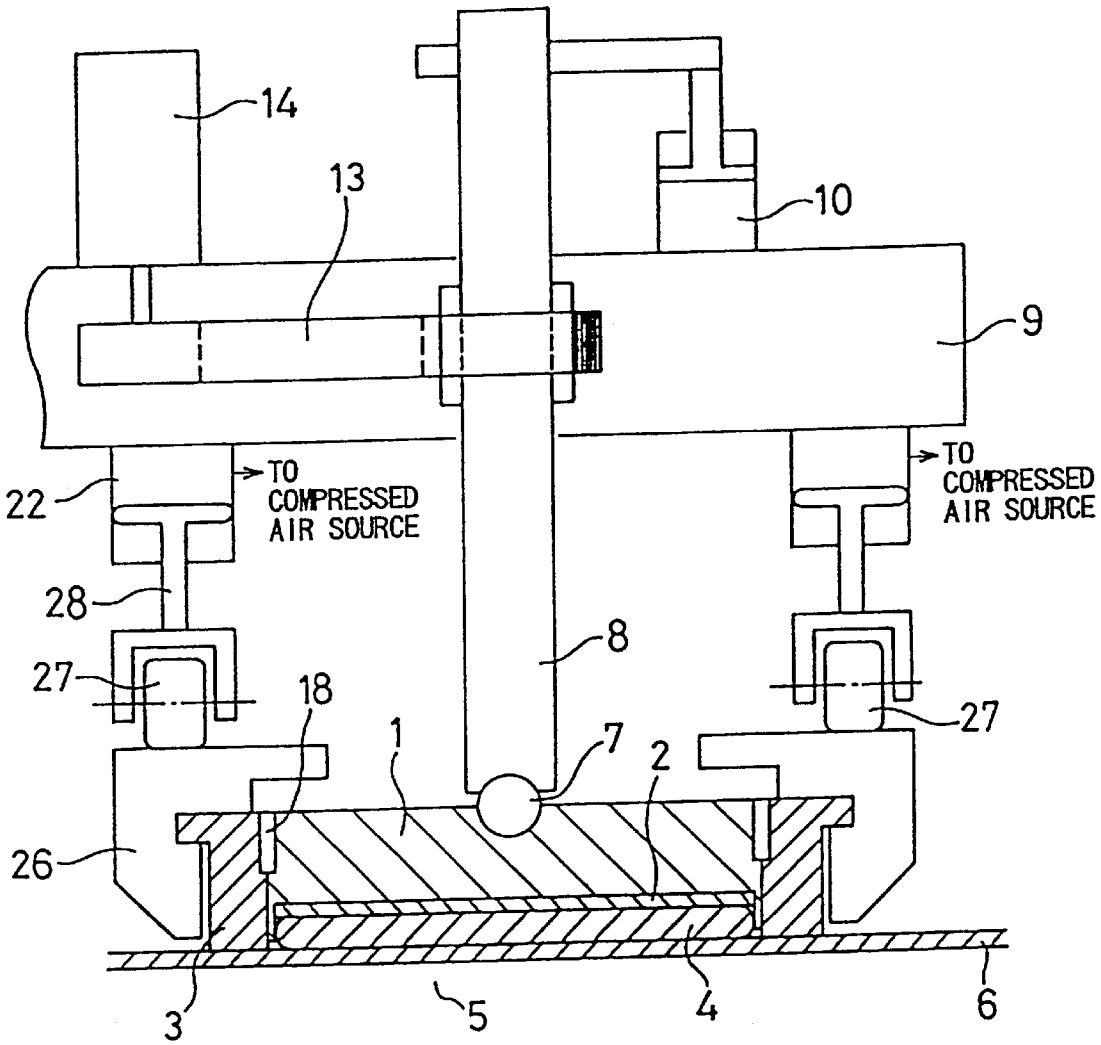
FIG. 7 is an enlarged fragmentary vertical cross-sectional view of a polishing apparatus according to a second embodiment of the present invention.

FIG. 7 shows a polishing apparatus according to a second embodiment of the present invention.

As shown in FIG. 7, the presser ring 3 disposed around the top ring 1 is held by a presser ring holder 26 which can be pressed downwardly by a plurality of rollers 27. The rollers 27 are rotatably supported by respective shafts 28 which are connected to the respective presser ring air cylinders 22 fixed to the lower surface of the top ring head 9. The presser ring 3 is vertically movable with respect to the top ring 1, and rotatable in unison with the top ring 1, as with the first embodiment shown in FIGS. 4 through 6.

In operation, while the top ring 1 and the presser ring 3 are rotated, the rollers 27 are rotated about their own axis while the rollers 27 are in rolling contact with the presser ring holder 26. At this time, the presser ring 3 is pressed downwardly by the rollers 27, which are lowered by the presser ring air cylinders 22, thereby pressing the abrasive cloth 6.

Other structural and functional details of the polishing apparatus according to the second embodiment are identical to those of the polishing apparatus according to the first embodiment.

In the first and second embodiments, the pressing force is transmitted from the presser ring air cylinders 22 to the presser ring 3 through the shafts 21, 28 which are independently positioned around the top ring shaft 8 and are not rotated integrally with the top ring shaft 8. Consequently, it is possible to vary the pressing force applied to the presser ring 3 during the polishing process, i.e., while the semiconductor wafer 4 is being polished.

Figure 8:
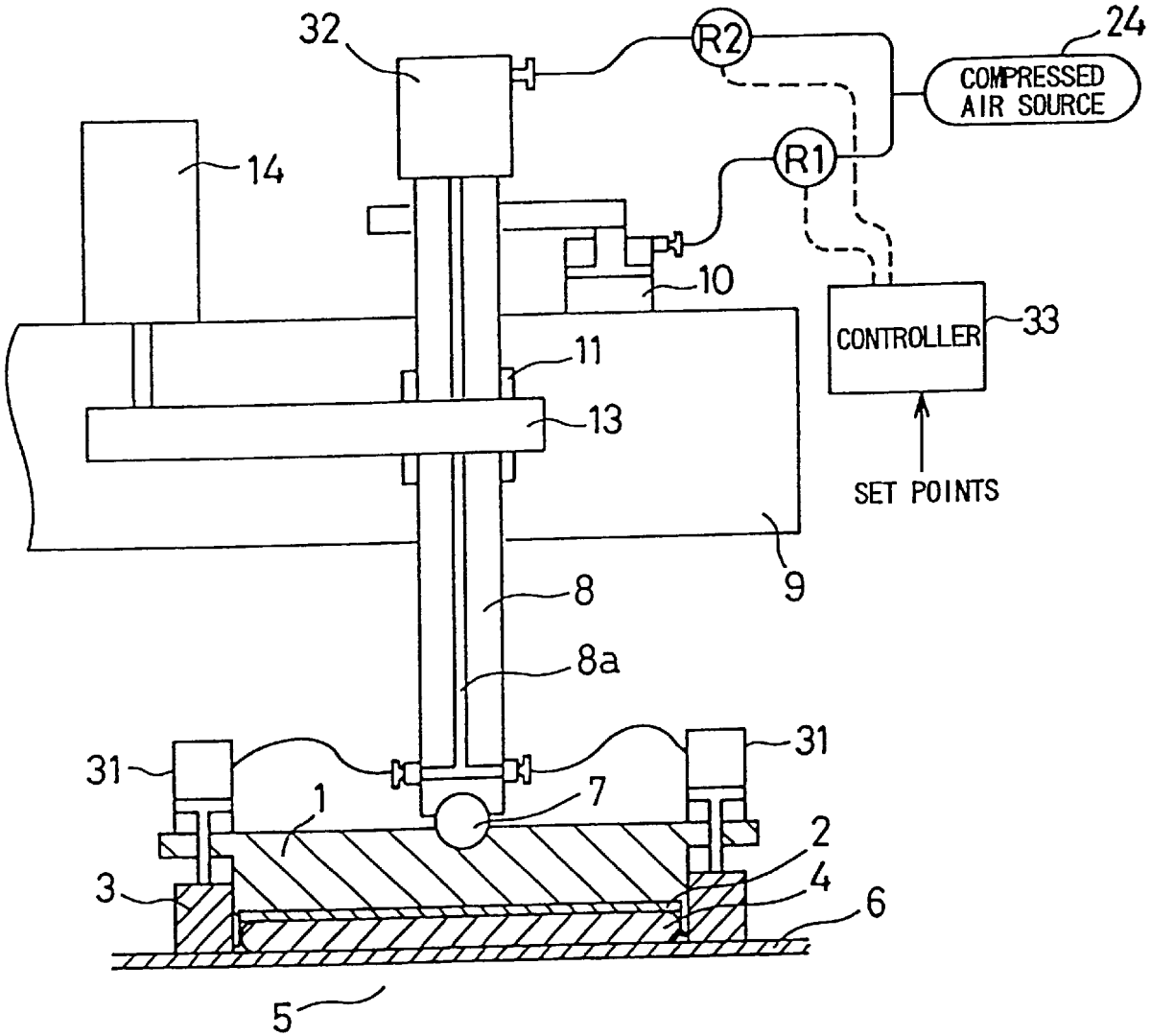
FIG. 8 is an enlarged fragmentary vertical cross-sectional view of a polishing apparatus according to a third embodiment of the present invention.

FIG. 8 shows a polishing apparatus according to a third embodiment of the present invention.

As shown in FIG. 8, the presser ring 3 disposed around the top ring 1 is connected to a plurality of presser ring air cylinders 31 fixedly mounted on the top ring 1. The presser ring air cylinders 31 are pneumatically connected to the compressed air source 24 through a communication passage 8*a* defined axially in the top ring shaft 8, a rotary joint 32 mounted on the upper end of the top ring shaft 8, and the regulator R2.

The top ring air cylinder 10 is pneumatically connected to the compressed air source 24 through the regulator R1. The regulators R1, R2 are electrically connected to a controller 33.

The polishing apparatus according to the third embodiment operates as follows: The semiconductor wafer 4 is polished by being pressed against the abrasive cloth 6 under the pressing force applied by the top ring 1 which is actuated by the top ring air cylinder 10. The presser ring 3 is pressed against the abrasive cloth 6 by the presser ring air cylinder 31. When the presser ring 3 is pressed against the abrasive cloth 6, the presser ring 3 is subjected to reactive forces which affect the pressing force applied by the top ring 1. To avoid such a problem, according to the third embodiment, setpoints for the pressing forces to be applied by the top ring 1 and the presser ring 3 are inputted to the controller 33, which calculates air pressures to be delivered to the top ring air cylinder 10 and the presser ring air cylinders 31. The controller 33 then controls the regulators R1, R2 to supply the calculated air pressures to the top ring air cylinder 10 and the presser ring air cylinders 31, respectively. Therefore, the top ring 1 and the presser ring 3 can apply desired pressing forces to the semiconductor wafer 4 and the abrasive cloth 6, respectively. The pressing forces applied by the top ring 1 and the presser ring 3 can thus be changed independently of each other while the semiconductor wafer 4 is being polished.

Other structural and functional details of the polishing apparatus according to the third embodiment are identical to those of the polishing apparatus according to the first embodiment.

In the third embodiment; the compressed air is supplied from the compressed air source 24 through the rotary joint 32 to the presser ring air cylinders 31. As a consequence, the pressing force applied by the presser ring 3 can be changed during the polishing process, i.e., while the semiconductor wafer 4 is being polished.

Figure 9:
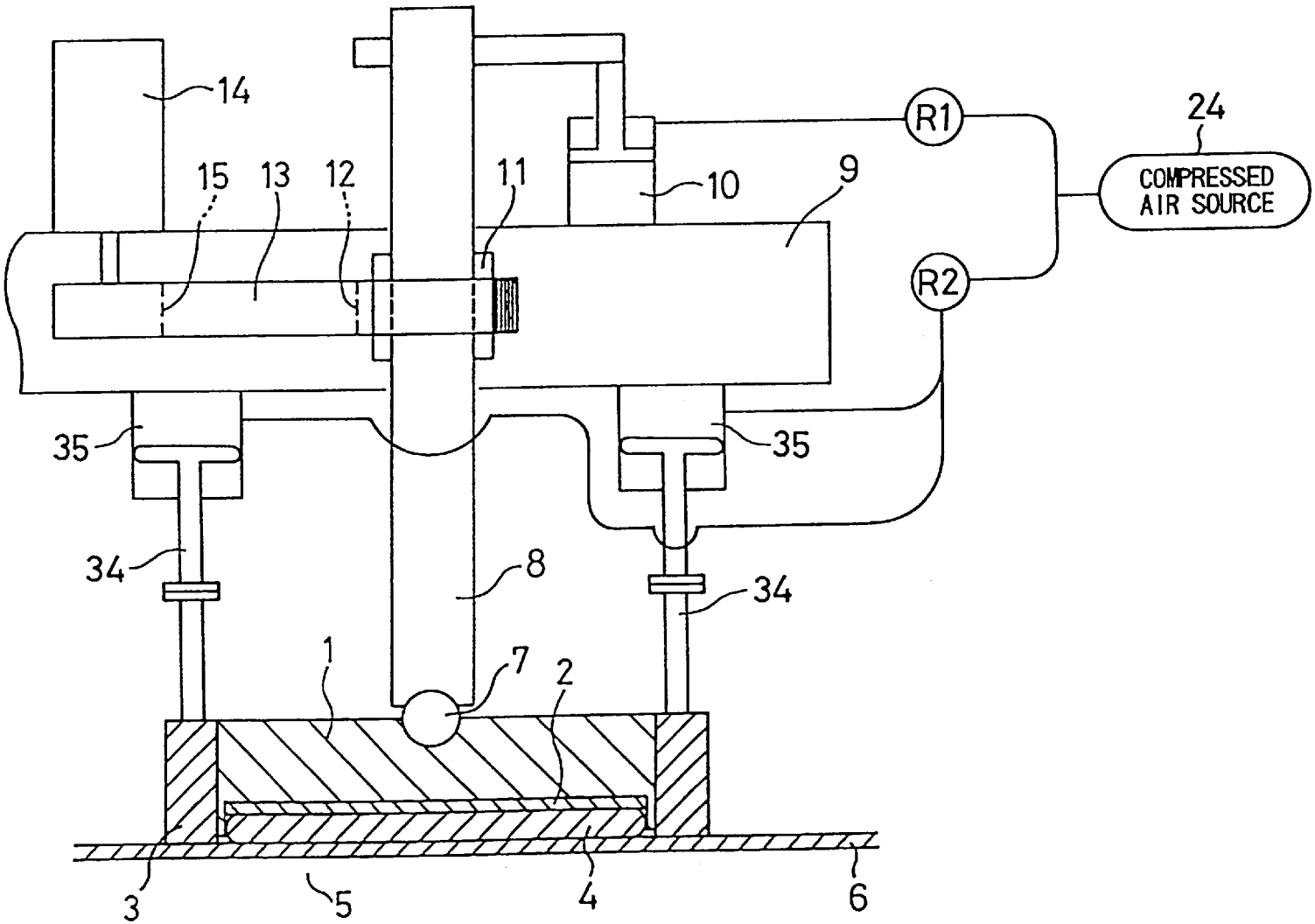
FIG. 9 is an enlarged fragmentary vertical cross-sectional view of a polishing apparatus according to a fourth embodiment of the present invention.

FIG. 9 shows a polishing apparatus according to a fourth embodiment of the present invention.

As shown in FIG. 9, the presser ring 3 disposed around the top ring 1 is connected to a plurality of presser ring air cylinders 35 through shafts 34. Each of the presser ring air cylinders 35 is fixed to the top ring head 9. The presser ring air cylinders 35 are circumferentially spacedly provided on the top ring head 9.

The top ring air cylinder 10 and the presser ring air cylinders 35 are pneumatically connected to a compressed air source 24 through regulators R1, R2, respectively. The regulator R1 regulates an air pressure supplied from the compressed air source 24 to the top ring air cylinder 10 to adjust the pressing force which is applied by the top ring 1 to press the semiconductor wafer 4 against the abrasive cloth 6. The regulator R2 also regulates the air pressure supplied from the compressed air source 24 to the presser ring air cylinder 35 to adjust the pressing force which is applied by the presser ring 3 to press the abrasive cloth 6.

In this embodiment, there is no transmitting means such as a key for transmitting rotation of the top ring 1 to the presser ring 3 between the top ring 1 and the presser ring 3. Therefore, during the polishing process, the top ring 1 is rotated about its own axis, but the presser ring 3 is not rotated about its own axis. Thus, the rotating torque of the top ring 1 is not transmitted to the presser ring 3, and the rotating load of the top ring shaft 8 is smaller than those of the first through third embodiments. Further, the presser ring 3 can be directly actuated by the presser ring air cylinders 35 fixedly mounted on the top ring head 9, thus simplifying the structure of the polishing apparatus.

Other structural and functional details of the polishing apparatus according to the fourth embodiment are identical to those of the polishing apparatus according to the first through third embodiments.

Figure 10:
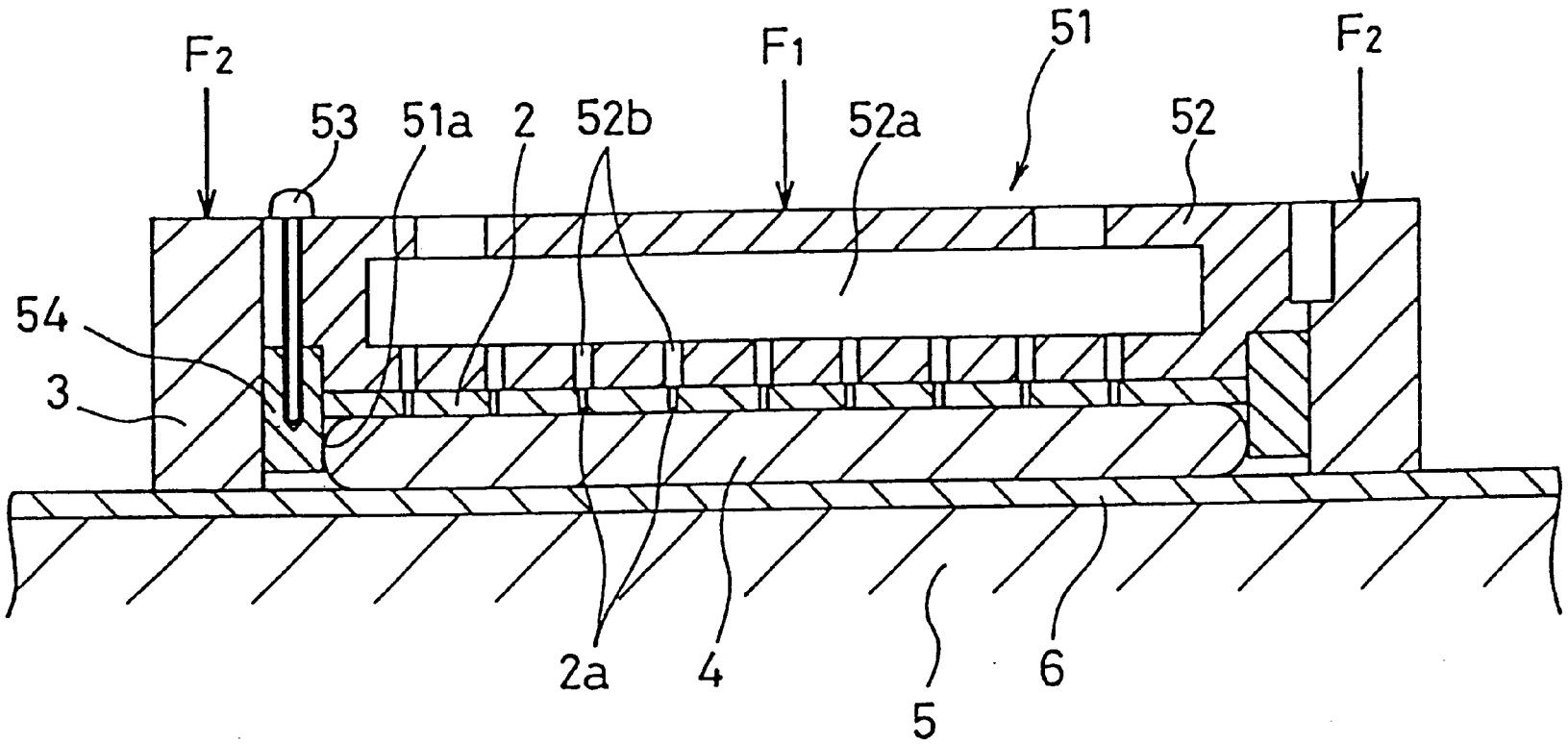
FIG. 10 is an enlarged vertical cross-sectional view showing a modified top ring.

FIG. 10 shows a modified top ring. As shown in FIG. 10, a top ring 51 comprises a main body 52 and a retaining portion in the form of a ring member 54 detachably fixed by bolts 53 to a lower outer circumferential surface of the main body 52. The top ring 51 has a recess 51*a* for accommodating the semiconductor wafer 4. The recess 51*a* is defined by a lower surface of the main body 52 and an inner circumferential surface of the ring member 54. The semiconductor wafer 4 accommodated in the recess 51*a* has an upper surface held by the lower surface of the main body 52 and an outer circumferential surface held by the inner circumferential surface of the ring member 54. The presser ring 3 is vertically movably disposed around the top ring 51.

The main body 52 of the top ring 51 has a chamber 52*a* defined therein which may be evacuated or supplied with a fluid such as pressurized air, water, or the like. The main body 52 also has a plurality of vertical communication holes 52*b* defined therein in communication with the chamber 52*a* and having lower ends opening at the lower surface of the main body 52. The elastic pad 2 is attached to the lower surface of the main body 52 and has a plurality of openings 2*a* defined therein and aligned with the vertical communication holes 52*b*, respectively in communication therewith. When the chamber 52*a* is evacuated, the upper surface of the semiconductor wafer 4 accommodated in the recess 51*a* is attracted under vacuum to the lower surface of the elastic pad 2. When the chamber 52*a* contains pressurized air or water, the pressurized air or water is supplied to the upper surface of the semiconductor wafer 4.

According to this embodiment, the ring member 54 and the presser ring 3 can be made up of optimum materials. The ring member 54 has an inner circumferential surface which contacts an outer circumferential surface of the semiconductor wafer 4, and a lower end which does not contact the abrasive cloth 6. Therefore, the ring member 54 can be made of material having a relatively soft surface layer such as synthetic resin or a metal coated with synthetic resin. If hard material is used as the ring member 54, the semiconductor wafer 4 is liable to be damaged during polishing process. The presser ring 3 has an inner circumferential surface which does not contact the semiconductor wafer 4, and a lower end which contacts the abrasive cloth 6. Therefore, the presser ring 3 can be made of material having high hardness and high abrasion resistance. There is a demand that the presser ring 3 has high abrasion resistance and small frictional resistance against the abrasive cloth 6, and produces, by abrasion, ground-off particles which do not adversely affect semiconductor devices on the semiconductor wafer. As described above, since the presser ring 3 does not contact the semiconductor wafer 4, it is not necessary to use material having a relatively soft surface layer, and thus the presser ring 3 can be made of optimum material so as to satisfy the above demand.

Figure 11:
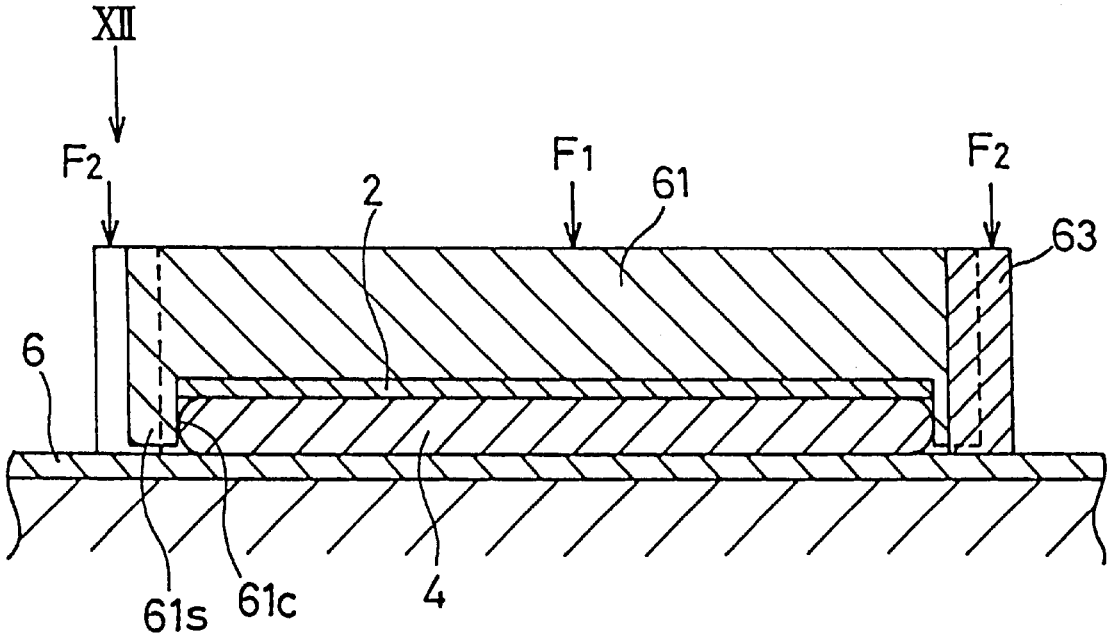
FIG. 11 is an enlarged vertical cross-sectional view showing another modified top ring.
Figure 12:
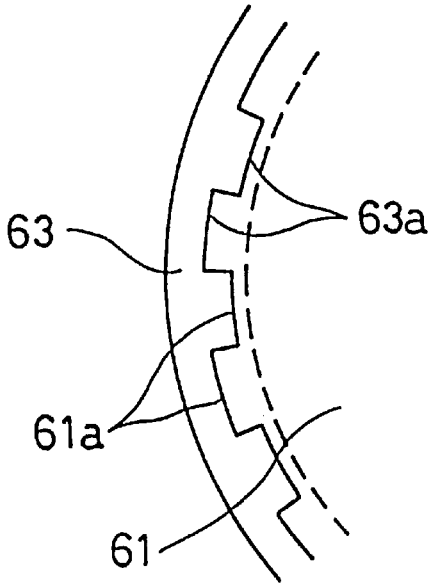
FIG. 12 is a fragmentary plan view of the modified top ring shown in FIG. 11, as viewed in the direction indicated by the arrow XII.

FIGS. 11 and 12 illustrate another modified top ring. As shown in FIGS. 11 and 12, a top ring 61 has a plurality of circumferential spaced teeth 61*a* on an outer circumferential surface thereof, and a presser ring 63 vertically movably disposed around the top ring 61 has a plurality of circumferential spaced teeth 63*a* on an inner circumferential surface thereof. The teeth 61*a* of the top ring 61 are held in mesh engagement with the teeth 63*a* of the presser ring 63 for causing the top ring 61 and the presser ring 63 to rotate in unison with each other while allowing the presser ring 63 to move vertically with respect to the top ring 61. The top ring 61 has an annular flange 61*s* which serves to retain the semiconductor wafer 4 underneath the top ring 61. The lower surface of the top ring 61 and the annular flange 61*s* jointly define a recess 61*c* for accommodating the semiconductor wafer 4 therein. The annular flange 61s is radially thicker at the teeth 61*a*. Since, however, the teeth 63*a* of the presser ring 63 extend radially inwardly between the teeth 61*a*, the presser ring 63 can effectively press the abrasive cloth 6 downwardly regardless of the relatively large radial thickness of the annular flange 61*s* at the teeth 61*a*.

Figure 13:
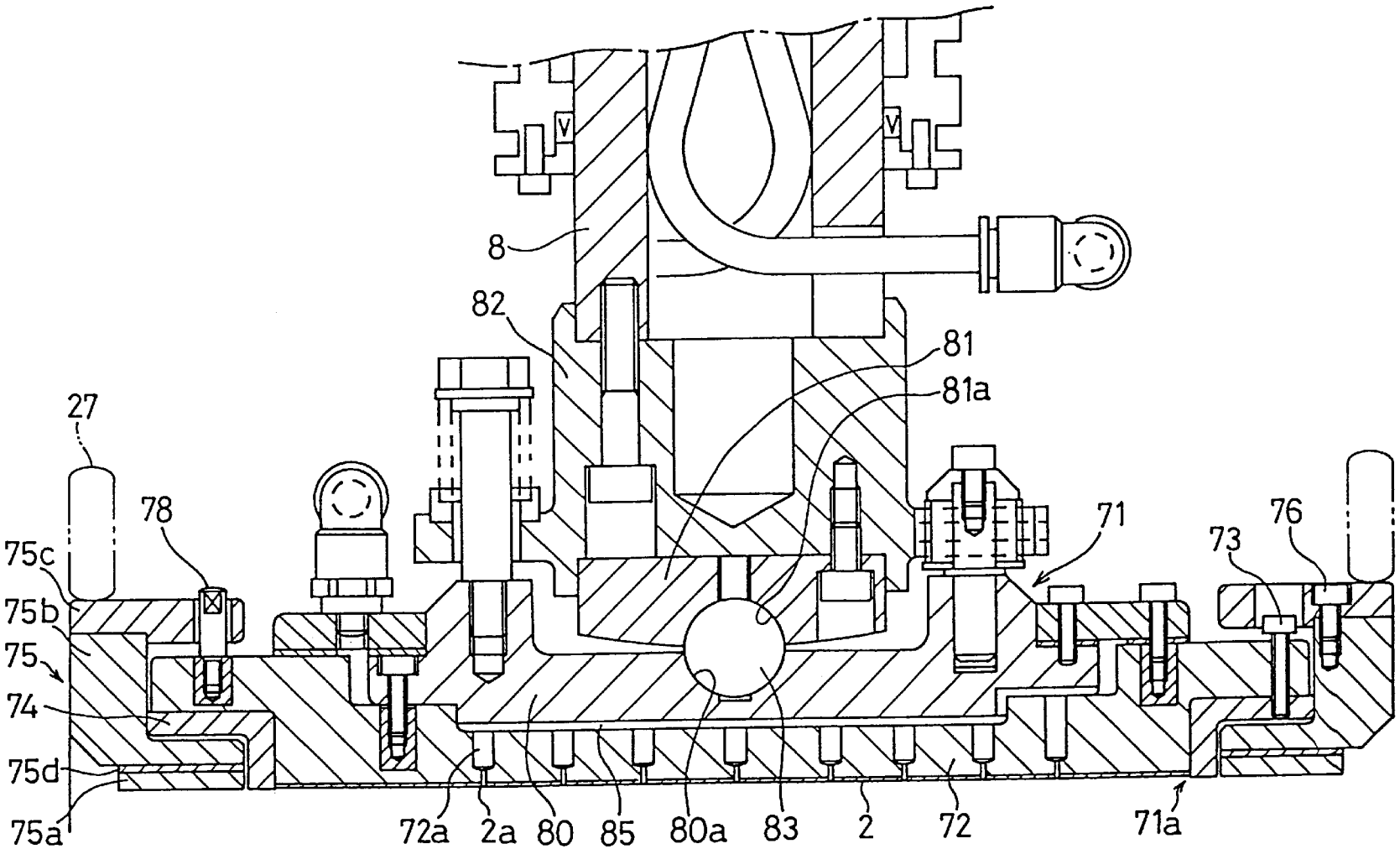
FIG. 13 is an enlarged fragmentary vertical cross-sectional view of a polishing apparatus according to a fourth embodiment of the present invention.

FIG. 13 shows a top ring and associated components of a polishing apparatus according to a fourth embodiment of the present invention. As shown in FIG. 13, a top ring 71 comprises a main body 72 and a ring member 74 of L-shaped cross section detachably fixed by bolts 73 to a lower outer circumferential surface of the main body 72. The top ring 71 has a recess 71*a* for accommodating the semiconductor wafer (not shown in the drawing). The recess 71*a* is defined by a lower surface of the main body 72 and an inner circumferential surface of the ring member 74. The semiconductor wafer accommodated in the recess 71*a* has an upper surface held by the lower surface of the main body 72 and an outer circumferential surface held by the inner circumferential surface of the ring member 74.

A presser ring 75 is vertically movably disposed around the top ring 71, i.e., the main body 72 and the ring member 74. The presser ring 75 comprises a first ring member 75*a* of a resin material which is located in a lowermost position for contacting the abrasive cloth 6, a second ring member 75*b* of L-shaped cross section disposed on the first ring member 75*a*, and a third ring member 75*c* disposed on the second ring member 75*b*. The first and second ring members 75*a*, 75*b* are integrally joined to each other with a tape 75*d* interposed therebetween. The second and third ring members 75*b*, 75*c* are integrally fixed to each other by bolts 76. The presser ring 75 engages a pin 78 fixed to the main body 72 of the top ring 71 for rotation with the top ring 71.

An attachment flange 80 having a partly spherical concave surface 80*a* in its upper central region is fixed to the main body 72 of the top ring 71. A drive shaft flange 82 which holds a member 81 having a partly spherical concave surface 81*a* on its lower central region is fixed to the lower end of the top ring shaft 8. A ball 83 is interposed between the partly spherical concave surfaces 80*a*, 81*a*. A gap 85 is defined between the main body 72 of the top ring 71 and the attachment flange 80. The gap 85 may be evacuated or supplied with a fluid such as pressurized air, water, or the like. The main body 72 has a plurality of vertical communication holes 72*a* defined therein in communication with the gap 85 and having lower ends opening at the lower surface of the main body 72. The elastic pad 2 is attached to the lower surface of the main body 72 and has a plurality of openings 2*a* defined therein and aligned with the vertical communication holes 72*a*, respectively in communication therewith. When the gap 85 is evacuated, the upper surface of the semiconductor wafer 4 accommodated in the recess 71*a* is attracted under vacuum to the lower surface of he elastic pad 2. When the gap 85 contains pressurized air or after, the pressurized air or water is supplied to the upper surface of the semiconductor wafer 4.

The presser ring 75 is of a substantially L-shaped cross-sectional shape, and extends radially inwardly into the main body 72 of the top ring 71. Therefore, even though the presser ring 75 does not have a large outside diameter far beyond the outside diameter of the top ring 71, the area of the presser ring 75 which is held in contact with the abrasive cloth 6 is relatively large. The presser ring 75 can be pressed against the abrasive cloth 6 by the rollers 27 vertically movable by the presser ring air cylinders as with the second embodiment shown in FIG. 7.

Other structural and functional details of the polishing apparatus according to this embodiment are identical to those of the polishing apparatus according to the first embodiment.

Figure 14A:
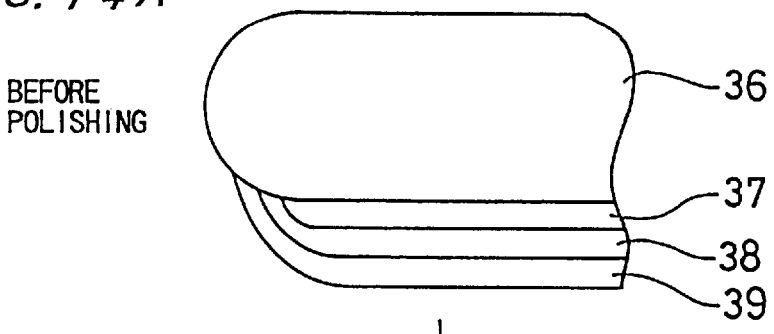
FIGS. 14A through 14D are enlarged fragmentary vertical cross-sectional views showing an example in which the amount of a material removed from a peripheral portion of a workpiece is smaller than the amount of a material removed from an inner region of the workpiece.
Figure 14B:
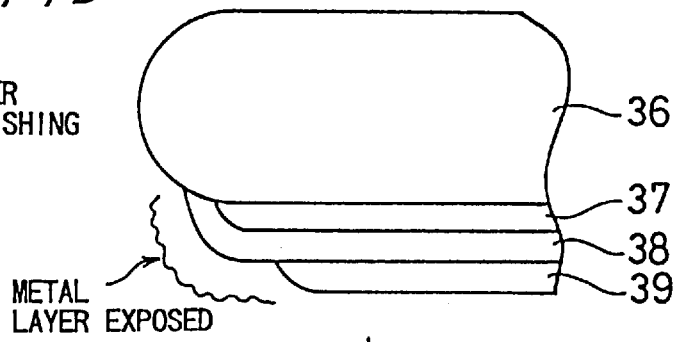
Figure 14C:
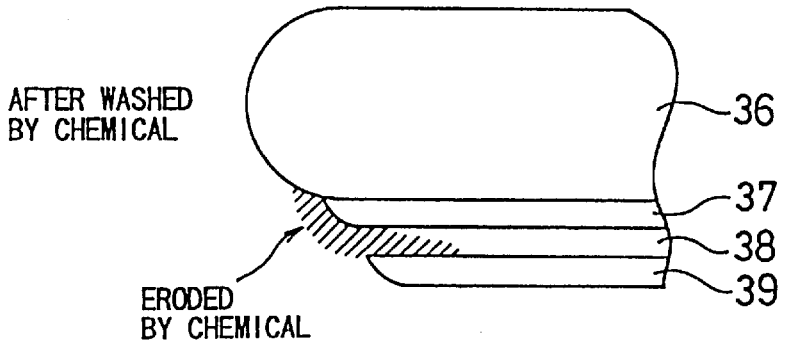
Figure 14D:
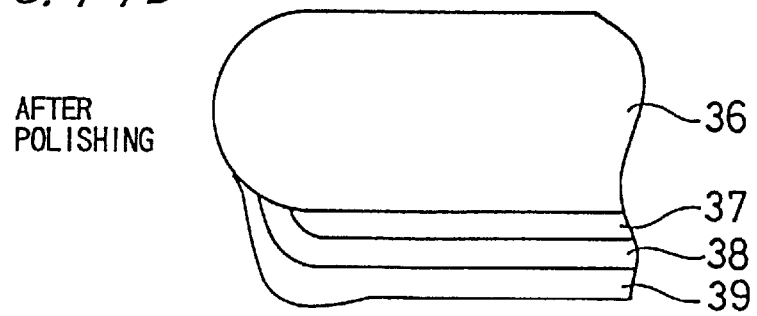
Figure 15:
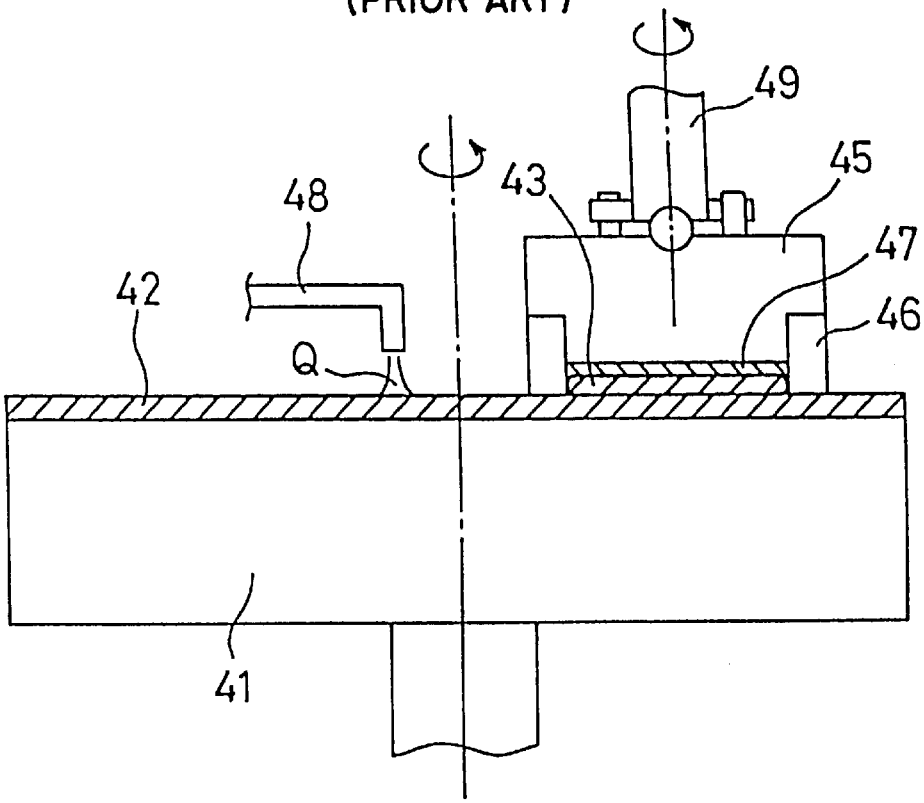
FIG. 15 (PRIOR ART)
FIG. 15 is a vertical cross-sectional view of a conventional polishing apparatus.
Figure 16:
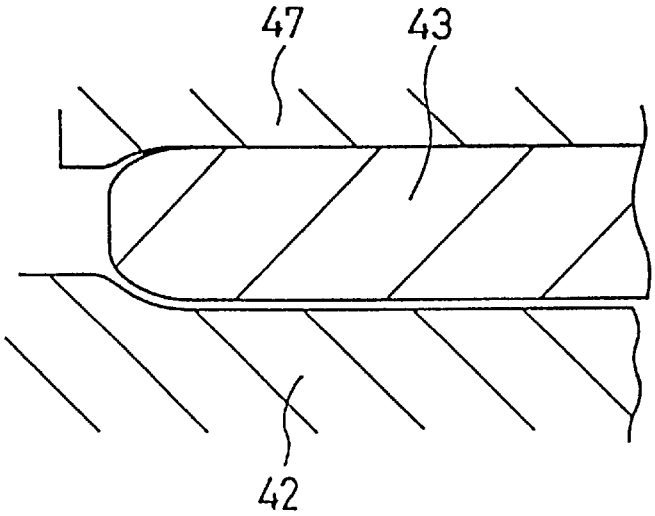
FIG. 16 (PRIOR ART)
FIG. 16 is an enlarged fragmentary vertical cross-sectional view of a semiconductor wafer, an abrasive cloth, and an elastic pad of the conventional polishing apparatus.
Figure 17:
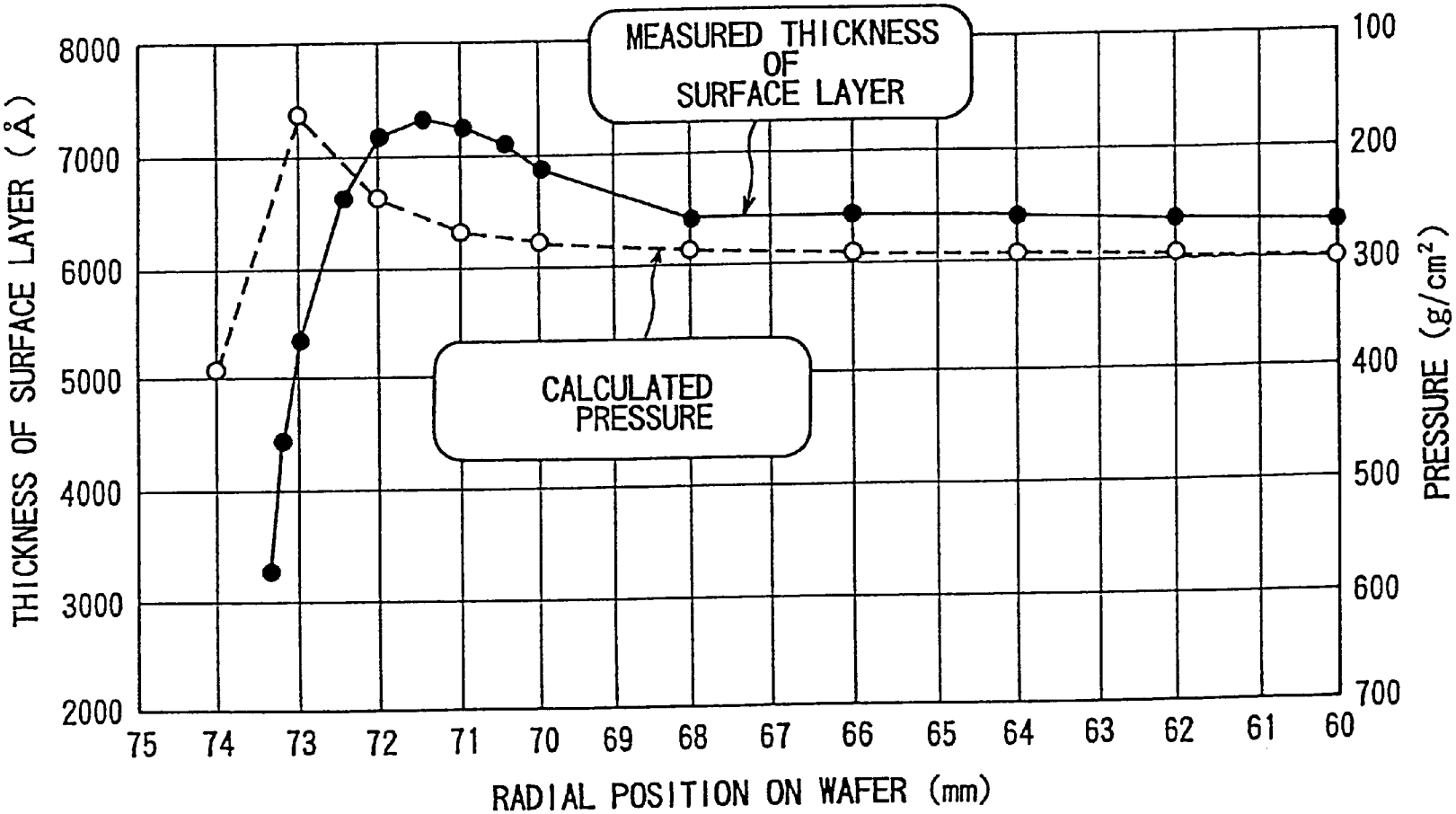
FIG. 17 is a graph showing the relationship between radial positions and polishing pressures, and the relationship between radial positions and thicknesses of a surface layer of a semiconductor wafer.

FIGS. 14A through 14D show an example in which the amount of a material removed from a peripheral portion of a workpiece is smaller than the amount of a material removed from an inner region of the workpiece. As shown in FIGS. 14A through 14D, a semiconductor device as a workpiece to be polished comprises a substrate 36 of silicon, an oxide layer 37 deposited on the substrate 36, a metal layer 38 deposited on the oxide layer 37, and an oxide layer 39 deposited on the metal layer 38. FIG. 14A illustrates the semiconductor device before it is polished, and FIG. 14B illustrates the semiconductor device after it is polished. After the semiconductor device is polished, the metal layer 38 is exposed on the peripheral edge thereof. When the polished semiconductor device is washed with a chemical, the exposed metal layer 38 is eroded by the chemical as shown in FIG. 14C. In order to prevent the exposed metal layer 38 from being eroded by the chemical, it is preferable to polish the semiconductor device such that the amount of a material removed from the peripheral portion of the semiconductor device will be smaller than the amount of a material removed from the inner region of the semiconductor device, thereby leaving the oxide layer 39 as a thick layer on the peripheral portion of the semiconductor device. The principles of the present invention are suitable for polishing the semiconductor device to leave the oxide layer 39 as a thick layer on the peripheral portion of the semiconductor device.

While the workpiece to be polished according to the present invention has been illustrated as a semiconductor wafer, it may be a glass product, a liquid crystal panel, a ceramic product, etc. The top ring and the presser ring may be pressed by hydraulic cylinders rather than the illustrated air cylinders. The presser ring may be pressed by electric devices such as piezoelectric or electromagnetic devices rather than the illustrated purely mechanical devices.

Although certain preferred embodiments of the present invention have been shown and described in detail, it should be understood that various changes and modifications may be made therein without departing from the scope of the appended claims.

We claim:

1. An apparatus for polishing a workpiece, said apparatus comprising:

a turntable with an abrasive cloth mounted on an upper surface thereof;

a top ring for holding a workpiece and pressing the workpiece against said abrasive cloth under a first pressing force to polish the workpiece, a presser ring positioned outwardly of said top ring, said presser ring being vertically movable relative to said top ring;

a pressing device for pressing said presser ring against said abrasive cloth under a second pressing force which is variable; and said presser ring and said top ring being relatively rotatable during polishing.

2. An apparatus according to claim 1, wherein said first pressing force and said second pressing force are variable independently of each other.

3. An apparatus according to claim 1, wherein said second pressing force is determined based on said first pressing force.

4. An apparatus according to claim 3, wherein said second pressing force is substantially equal to said first pressing force, thereby to enable removal of the same thickness of material from a peripheral portion of the workpiece as from an inner region of the workpiece.

5. An apparatus according to claim 3, wherein said second pressing force is smaller than said first pressing force, thereby to enable removal of a greater thickness of material from a peripheral portion of the workpiece than from an inner region of the workpiece.

6. An apparatus according to claim 3, wherein said second pressing force is greater than said first pressing force, thereby to enable removal of a smaller thickness of material from a peripheral portion of the workpiece than from an inner region of the workpiece.

7. An apparatus for polishing a workpiece, said apparatus comprising:

a turntable with polishing surface mounted on an upper surface thereof;

a top ring for holding a workpiece and pressing the workpiece against said polishing surface under a first pressing force to polish the workpiece;

a presser ring positioned outwardly of said top ring;

a pressing device for pressing said presser ring against said abrasive cloth under a second pressing force which is variable; and said presser ring comprising a plurality of members including a lowermost member contacting said polishing surface and an upper member, and said lowermost member being fixed to said upper member by adhesive.

8. An apparatus according to claim 7, wherein said first pressing force and said second pressing force are variable independently on each other.

9. An apparatus according to claim 7, wherein said second pressing force is determined based on said first pressing force.

10. An apparatus according to claim 9, wherein said second pressing force is substantially equal to said first pressing force thereby to enable removal of the same thickness of material from a peripheral portion of the workpiece as from an inner region of the workpiece.

11. An apparatus according to claim 9, wherein said second pressing force is smaller than said first pressing force, thereby to enable removal of a greater thickness of material from a peripheral portion of the workpiece than from an inner region of the workpiece.

12. An apparatus according to claim 9, wherein said second pressing force is greater than said first pressing force, thereby to enable removal of a smaller thickness of material from a peripheral portion of the workpiece than from an inner region of the workpiece.

13. An apparatus according to claim 7, wherein said lowermost member comprises resin material.

14. An apparatus according to claim 7, wherein said lowermost member is fixed to said upper member by a tape.

* * * * *